US009152086B2

(12) United States Patent
Ichikawa

(10) Patent No.: US 9,152,086 B2
(45) Date of Patent: Oct. 6, 2015

(54) TONER CARTRIDGE WITH DIFFERENTIAL MEMBER AND IMAGE FORMING APPARATUS

(71) Applicant: SHARP KABUSHIKI KAISHA, Osaka-shi, Osaka (JP)

(72) Inventor: Yoshiki Ichikawa, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 14/191,888

(22) Filed: Feb. 27, 2014

(65) Prior Publication Data

US 2015/0071685 A1 Mar. 12, 2015

(30) Foreign Application Priority Data

Sep. 10, 2013 (JP) ..... 2013-186977

(51) Int. Cl.
*G03G 15/08* (2006.01)

(52) U.S. Cl.
CPC ..... *G03G 15/0889* (2013.01); *G03G 15/0839* (2013.01); *G03G 15/0877* (2013.01)

(58) Field of Classification Search
CPC ..... G03G 15/0839; G03G 15/0877; G03G 15/0887; G03G 15/0889; G03G 2215/085
USPC ..... 399/263
See application file for complete search history.

(56) References Cited

U.S. PATENT DOCUMENTS

| | | | | |
|---|---|---|---|---|
| 5,243,389 | A * | 9/1993 | Yamane et al. | 399/254 |
| 7,110,703 | B2 * | 9/2006 | Uratani et al. | 399/254 |
| 7,751,757 | B2 * | 7/2010 | Kim et al. | 399/254 |
| 8,340,556 | B2 * | 12/2012 | Kunihiro et al. | 399/263 |
| 8,744,321 | B2 * | 6/2014 | Kubota et al. | 399/263 |
| 2011/0026974 | A1 | 2/2011 | Kunihiro et al. | |

FOREIGN PATENT DOCUMENTS

| | | | |
|---|---|---|---|
| JP | 05061341 | A * | 3/1993 |
| JP | 2011-033836 | | 2/2011 |
| JP | 2013148723 | A * | 8/2013 |

* cited by examiner

*Primary Examiner* — Robert Beatty
(74) *Attorney, Agent, or Firm* — Nixon & Vanderhye P.C.

(57) ABSTRACT

Toner cartridge and image forming apparatus are provided capable of reducing rotation torque on startup even if a toner is solidified. The toner cartridge includes a toner stirring member having a rotating shaft and a stirring blade; a toner discharge member having a spiral-shaped conveyance blade attached to a conveyance shaft; a second gear having a bearing projection protruding radially inwardly from an inner peripheral surface of an annular base part, which is rotatably supported in contact with an outer peripheral surface of the rotating shaft; an abutment member protruding from the outer peripheral surface of the rotating shaft, against which the bearing projection abuts under rotation of the second gear; first and third gears for transmitting rotation of the second gear to the conveyance shaft; and a rotationally driving section for imparting a rotating force to the second gear.

5 Claims, 6 Drawing Sheets

TONER CARTRIDGE WITH DIFFERENTIAL MEMBER AND IMAGE FORMING APPARATUS

CROSS-REFERENCE TO RELATED APPLICATION

This application claims priority to Japanese Patent Application No. 2013-186977, which was filed on Sep. 10, 2013, the contents of which are incorporated herein by reference in its entirety.

BACKGROUND OF THE TECHNOLOGY

1. Field of the Technology

The present technology relates to a toner cartridge which is used in an image forming apparatus using an electrophotographic system, and to an image forming apparatus.

2. Description of the Related Art

An image forming apparatus which is mounted in a printer, a copy machine, or the like forms an image using a toner which is stored in a developing device in the image forming apparatus. In the field of an image forming apparatus, a toner cartridge which supplies a toner to a developing device has been hitherto known. When the toner in the developing device is consumed, the toner cartridge supplies a toner in the toner cartridge into the developing device.

For example, in Japanese Unexamined Patent Publication JP-A 2011-33836, there is disclosed a toner cartridge comprising: a toner storage container having a toner storage section which for storing a toner which is supplied to a developing device and a toner discharge section having a toner discharge port, the toner discharge section being adjacent to the toner storage section; a toner stirring member disposed in the toner storage section, the toner stirring member having a toner stirring plate for stirring a toner stored in the toner storage section and a pair of flexible stirring blades for scooping up a toner stored in the toner storage section and conveying it to the toner discharge section; and a toner discharge member disposed in the toner discharge section, for conveying a toner which has been conveyed to the toner discharge section by the toner stirring member toward the toner discharge port.

In the toner cartridge disclosed in JP-A 2011-33836, the paired stirring blades are provided at an interval of 180 degrees in a circumferential direction of a rotating shaft, and are each disposed at the front end of each toner stirring plate protruding from the rotating shaft outwardly in a radial direction of the rotating shaft so as to extend in the radial direction outwardly. Each of the stirring blades is designed to have a length long enough to make contact with an inner surface of the toner storage section in the radial direction of the rotating shaft. In this construction, as the rotating shaft is rotated, a toner attached to the inner surface of the toner storage section can be scraped off by the paired stirring blades, wherefore the amount of toner residues that have remained on an inner wall of the toner storage section without being conveyed to the toner discharge section can be minimized.

However, in the toner cartridge disclosed in JP-A 2011-33836, since the toner conveying members start to rotate simultaneously immediately after the placement of the toner cartridge, it follows that, depending on an environment in which a toner is left standing, the toner may be solidified, with the consequence that a rotating motor is brought into a locked state, thus causing a malfunction.

Furthermore, there may be a case where a driving torque produced in a rotationally driving portion of the developing device is increased to exceed a permissible value. If the torque in the driving portion is increased to exceed a permissible value, for example, in an engagement part between gears disposed at the rotating shafts of a roller, a stirring member, etc., there will arise gear tooth slippage, or equivalently a phenomenon in which gear teeth are mutually slipped with the consequence that the gears are rotated at a dash by the number of slipped gear teeth, not rotating gears while engaging gear teeth one by one. If such a tooth slippage phenomenon occurs, the developing roller will be rotated at an excessively high speed, wherefore a sufficient amount of developer cannot be fed from the developing roller to an electrostatic latent image formed on the surface of an electrophotographic photoreceptor, which results in occurrence of image defects, namely so-called image voids.

SUMMARY OF THE TECHNOLOGY

An object of the technology is to provide a toner cartridge capable of reduction in rotation torque at a time of startup even where a toner discharge section having a toner discharge port is placed on a vertically lower side of a toner storage section and even where a toner is in a solidified state, as well as to provide an image forming apparatus.

The technology provides a toner cartridge mountable in an electrophotographic image forming apparatus provided with a developing device, comprising:

a toner storage container including a toner storage section for storing a toner in an interior thereof, a toner discharge section located on a vertically lower side of the toner storage section in a mounted state in the image forming apparatus, the toner discharge section having a toner discharge port for toner discharge, and a communicating port forming section which forms a communicating port for guiding a toner stored in the toner storage section toward the toner discharge section;

a toner stirring member which stirs a toner stored in the toner storage section, including a first rotating shaft rotatably supported on the toner storage section, and a flexible sheet-like stirring blade of which one end portion in a predetermined first direction perpendicular to a thickness direction is fixed to the first rotating shaft along an axial line thereof, the flexible sheet-like stirring blade having a length in the predetermined first direction so that the other end portion in the predetermined first direction comes into contact with an inner surface of the toner storage section with respect to the predetermined first direction;

a toner discharge member which conveys a toner which has been guided from the toner storage section to the toner discharge section through the communicating port toward the toner discharge port, including a second rotating shaft rotatably supported on the toner discharge section, and a spiral-shaped conveyance blade attached to the second rotating shaft along an axial line thereof;

a differential member including a base part composed of an annular plate body, and a bearing projection which protrudes radially inwardly from an inner peripheral surface of the base part, the bearing projection being rotatably supported in contact with an outer peripheral surface of the first rotating shaft;

an abutment member protruding from the outer peripheral surface of the first rotating shaft, against which the bearing projection abuts under a rotation of the differential member;

a rotation transmitting portion which transmits a rotation of the differential member to the second rotating shaft; and a rotationally driving section which imparts a rotating force to the differential member.

Moreover, it is preferable that a plurality of the bearing projections, as well as a plurality of the abutment members, are axisymmetrically disposed with respect to the axial line of the first rotating shaft.

Moreover, it is preferable that, in the base part, a plurality of substantially circular sector-shaped through holes are formed between the plurality of the bearing projections, and central angles of the respective plurality of substantially circular sector-shaped through holes are 90°.

Moreover, it is preferable that a single bearing protrusion and a single abutment member are provided.

Moreover, it is preferable that, in the base part, a substantially circular sector-shaped through hole is formed by the single bearing protrusion, and a central angle of the substantially circular sector-shaped through hole is 270°.

Moreover, it is preferable that the rotationally driving section rotates the differential member in normal and reverse directions within a certain movable range without causing a contact of the bearing projection with the abutment member.

Moreover, the technology provides an electrophotographic image forming apparatus provided with a developing device, comprising:

the toner cartridge which supplies a toner to the developing device.

In the toner cartridge, the toner stirring member is rotated as the bearing projection of the differential member abuts against the abutment member on startup, and also the rotation of the differential member is transmitted to the second rotating shaft via the rotation transmitting portion. Thus, even if a toner stored in the toner storage container is in a solidified state, the toner can be loosened by rotating only the toner discharge member first, and then the toner stirring member can be rotated without producing an excessive rotation torque.

Moreover, with the provision of the toner cartridge as above described in the image forming apparatus, it is possible to render the image forming apparatus capable of forming high-quality images without causing image defects such as an image void.

BRIEF DESCRIPTION OF THE DRAWINGS

Other and further objects, features, and advantages of the technology will be more explicit from the following detailed description taken with reference to the drawings wherein.

DETAILED DESCRIPTION

Figure 1:
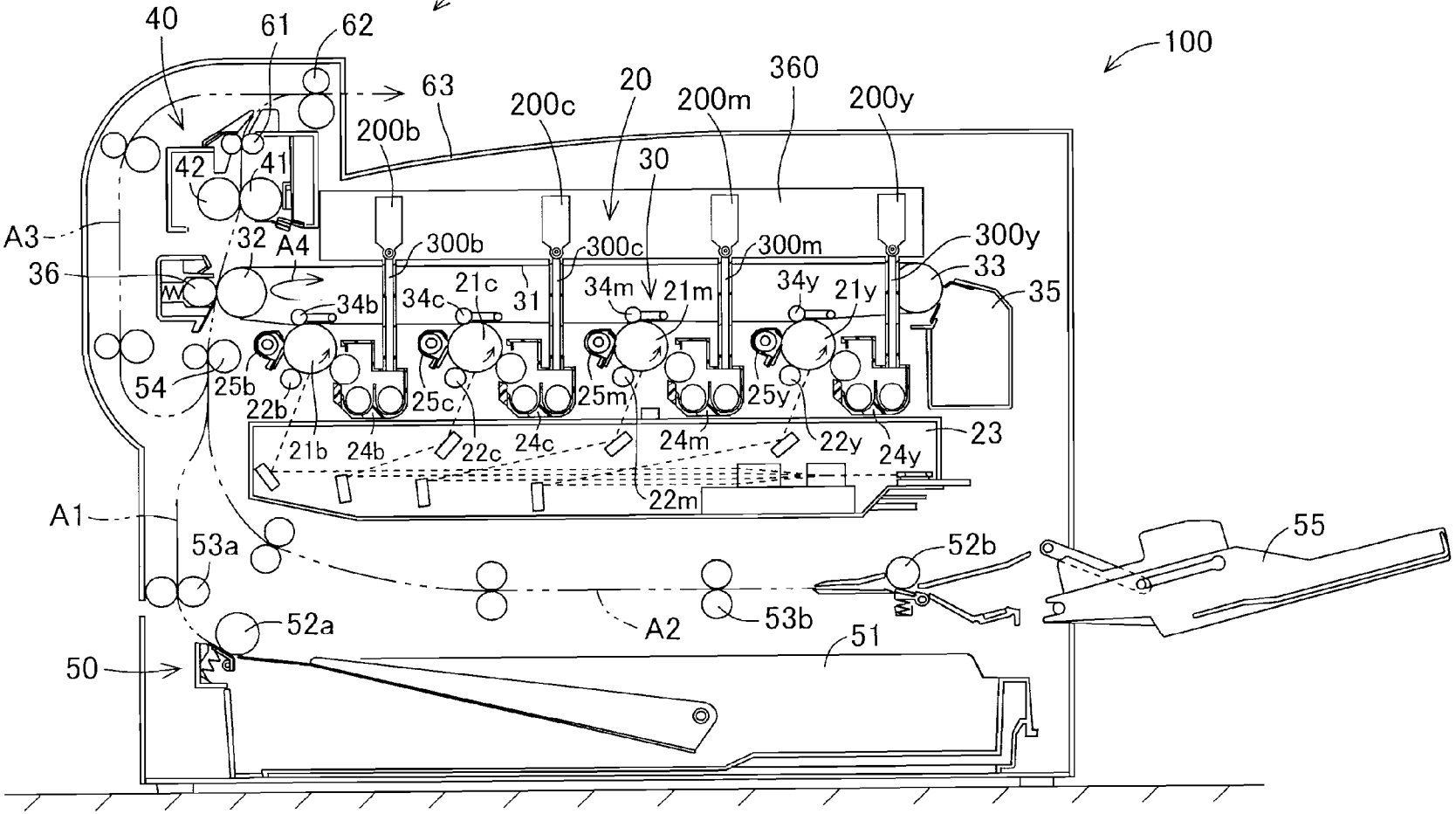
FIG. 1 is a sectional view schematically showing the structure of an image forming apparatus provided with a toner cartridge in accordance with a first embodiment.

Now referring to the drawings, preferred embodiments are described below.

FIG. 1 is a sectional view schematically showing the structure of an image forming apparatus 100 provided with a toner cartridge 200 in accordance with a first embodiment (Example 1). To begin with, the image forming apparatus 100 will be described with reference to the drawing. The image forming apparatus 100 of the present embodiment is built as a multi-function machine having a copier function, a printer function, and a facsimile function, for forming a full-color or monochromatic image on a recording medium in response to image information transmitted thereto. The image forming apparatus 100 has three printing modes, namely a copier mode (duplicator mode), a printer mode, and a facsimile mode, and, in the image forming apparatus 100, in response to a manipulated input from an operating section (not shown), and a receipt of a print job from a personal computer, a portable terminal, an information recording medium, external equipment using a memory device, and so forth, printing mode selection is made by a control unit section (not shown).

The image forming apparatus 100 includes a toner image forming section 20, a transfer section 30, a fixing section 40, a recording medium feeding section 50, a discharge section 60, and a control unit section (not shown). The toner image forming section 20 includes photoreceptor drums 21*b*, 21*c*, 21*m*, and 21*y*, charging sections 22*b*, 22*c*, 22*m*, and 22*y*, an exposure unit 23, developing devices 24*b*, 24*c*, 24*m*, and 24*y*, cleaning units 25*b*, 25*c*, 25*m*, and 25*y*, toner cartridges 200*b*, 200*c*, 200*m*, and 200*y*, and toner supply pipes 300*b*, 300*c*, 300*m*, and 300*y*.

The toner cartridges 200*b*, 200*c*, 200*m*, and 200*y* are provided in the form of a toner cartridge unit 360. The toner cartridges 200*b*, 200*c*, 200*m*, and 200*y* will be described later. The transfer section 30 includes an intermediate transfer belt 31, a driving roller 32, a driven roller 33, intermediate transfer rollers 34*b*, 34*c*, 34*m*, and 34*y*, a transfer belt cleaning unit 35, and a transfer roller 36.

In order to deal with image information on four colors, namely black (b), cyan (c), magenta (m), and yellow (y) included in color image data on an individual basis, the photoreceptor drum 21, the charging section 22, the developing device 24, the cleaning unit 25, the toner cartridge 200, the toner supply pipe 300, and the intermediate transfer roller 34 are each correspondingly four in number.

In this specification, these four constituent components that are identical in type but are adapted to different colors are distinguishable according to color-indicating alphabetical suffixes added to the reference numerals designating the components, and collectively, the components are represented only by their respective reference numerals.

The photoreceptor drum 21, which is supported so that it can be driven to rotate about its axial line by a driving section (not shown), comprises an electrically-conductive base body and a photoconductive layer formed on the surface of the electrically-conductive base body, which are not shown. The electrically-conductive base body may be formed in various shapes, for example, a cylindrical shape, a circular columnar shape, and a lamellar sheet shape. The photoconductive layer is made of a material which exhibits electrical conductivity through light irradiation. As the photoreceptor drum 21, it is possible to use, for example, a component comprising a cylindrical member made of aluminum (electrically-conductive base body), and a thin film (photoconductive layer) made of amorphous silicon (a-Si), selenium (Se), or an organic optical semiconductor (OPC) that is formed on the outer periphery of the cylindrical member.

The charging section 22, the developing device 24, and the cleaning unit 25 are arranged in the order named along a rotational direction of the photoreceptor drum 21. The charging section 22 is disposed vertically below the developing device 24 and the cleaning unit 25.

The charging section 22 is a device for charging the surface of the photoreceptor drum 21 to a predetermined potential with a predetermined polarity. The charging section 22 is positioned face-to-face with the photoreceptor drum 21 so as to lie along a longitudinal direction of the photoreceptor drum 21. When a contact charging system is adopted, the charging section 22 is placed in contact with the surface of the photoreceptor drum 21. On the other hand, when a non-contact charging system is adopted, the charging section 22 is placed away from the surface of the photoreceptor drum 21.

The charging section 22 is, together with the developing device 24 and the cleaning unit 25, disposed around the photoreceptor drum 21. It is preferable that the charging section 22 lies closer to the photoreceptor drum 21 than the developing device 24 as well as the cleaning unit 25. This makes it possible to prevent occurrence of a charging failure at the photoreceptor drum 21 without fail.

As the charging section 22, a charging device of brush type, a charging device of roller type, a corona discharge device, an ion generating device, and so forth can be used. The brush-type charging device and the roller-type charging device are each a charging device adapted for the contact charging system. Some brush-type charging devices employ a charging brush, and others employ a magnetic brush, for example. The corona discharge device and the ion generating device are each a charging device adapted for the non-contact charging system. Some corona discharge devices employ a wire-type discharge electrode, others employ a pin array-type discharge electrode, and still others employ a needle-type electrode, for example.

The exposure unit 23 is placed so that light emitted therefrom can be applied, through a region between the charging section 22 and the developing device 24, to the surface of the photoreceptor drum 21. By the exposure unit 23, the surfaces of the photoreceptor drums 21*b*, 21*c*, 21*m*, and 21*y* in a charged state are irradiated with laser light corresponding to image information of their respective colors, whereby on the surfaces of the photoreceptor drums 21*b*, 21*c*, 21*m*, and 21*y* are formed electrostatic latent images corresponding to image information of their respective colors. As the exposure unit 23, for example, a laser scanning unit (LSU) having a laser irradiation section and a plurality of reflection mirrors can be used. It is also possible to use, as the exposure unit 23, a unit constructed by combining an LED (Light Emitting Diode) array, a liquid crystal shutter, and a light source in a proper manner.

The toner cartridge 200 is disposed vertically above the developing device 24, for storing an unused toner. The toner cartridge 200 is, at its vertically lower part, connected with the toner supply pipe 300 which is a tubular member. The toner cartridge 200 supplies a toner to the developing device 24 via the toner supply pipe 300. The details of the toner cartridge 200 will be will be given below.

The developing device 24 is a device for forming a toner image on the photoreceptor drum 21 by developing an electrostatic latent image formed on the photoreceptor drum 21 with a toner. The developing device 24 is, at its vertically upper part, connected with the toner supply pipe 300.

The developing device 24 comprises a developer tank, a developing roller, a first conveying screw, a second conveying screw, and a toner concentration detection sensor. The developer tank stores a toner in its internal space. Within the developer tank, the developing roller, the first conveying screw, and the second conveying screw are rotatably supported. The developer tank has an opening formed in a location thereof opposed to the photoreceptor drum 21, and, the developing roller is positioned so as to face the photoreceptor drum 21, with the opening lying therebetween.

The developing roller is a member which supplies a toner to an electrostatic latent image formed on the surface of the photoreceptor drum 21 in a location closest to the photoreceptor drum 21. At the time of toner supply, the surface of the developing roller is subjected to application of a potential of a polarity reverse to the polarity of a charge potential on a toner (development bias). This allows smooth supply of a toner on the surface of the developing roller to an electrostatic latent image. By making changes to the value of the development bias, it is possible to control the amount of a toner (the amount of toner to be attached) to be supplied to the electrostatic latent image.

The first conveying screw is a member opposed to the developing roller, for supplying a toner to a region around the developing roller. The second conveying screw is a member opposed to the first conveying screw, for supplying a toner, which is newly supplied into the developer tank via the toner supply pipe 300, to a region around the first conveying screw.

On the bottom of the developer tank is disposed the toner concentration detection sensor. The toner concentration detection sensor detects the concentration of a toner contained in the developer tank. As the toner concentration detection sensor, a typical toner concentration detection sensor can be used, and the example thereof include a transmitted light detection sensor, a reflected light detection sensor, and a permeability detection sensor. Among them, the permeability detection sensor is desirable for use.

The toner concentration detection sensor is electrically connected to a toner concentration control section. The toner concentration control section is designed to exercise toner control in a manner such that, when it determines that a toner concentration value produced by the toner concentration detection sensor is lower than a predetermined value, then a toner discharge member 220 disposed in the toner cartridge 200, which will hereafter be described, is driven to rotate to supply a toner in the toner cartridge 200 into the developer tank.

The cleaning unit 25 is a member which removes toner residues remaining on the surface of the photoreceptor drum 21 following the completion of transfer of a toner image from the photoreceptor drum 21 to the intermediate transfer belt 31, for cleaning the surface of the photoreceptor drum 21. As the cleaning unit 25, for example, a plate-like member for scraping off a toner, and a container-like member for collecting the scraped toner are used.

According to the toner image forming section 20, the surface of the photoreceptor drum 21 in a state of being uniformly charged by the charging section 22 is irradiated with laser light corresponding to image information emitted from the exposure unit 23, thereby forming an electrostatic latent image. Then, a toner is supplied from the developing device 24 to the electrostatic latent image formed on the photoreceptor drum 21, thereby forming a toner image. The toner image is transferred to the intermediate transfer belt 31 which will hereafter be described. After the toner image is transferred to the intermediate transfer belt 31, toner residues remaining on the surface of the photoreceptor drum 21 are removed by the cleaning unit 25.

The intermediate transfer belt 31 is an endless belt-shaped member placed vertically above the photoreceptor drum 21. The intermediate transfer belt 31 is supported around the driving roller 32 and the driven roller 33 with tension to form a loop-like path, and runs in a direction indicated by an arrow A4.

The driving roller 32 is disposed so as to be rotatable about its axial line by a driving section (not shown).

The driving roller 32 causes the intermediate transfer belt 31 to run in the direction of the arrow A4 under its rotation. The driven roller 33 is disposed so as to be rotatable in accordance with the rotation of the driving roller 32, and generates a constant tension to the intermediate transfer belt 31 so that the intermediate transfer belt 31 does not go slack.

The intermediate transfer roller 34 is provided to come into pressure-contact with the photoreceptor drum 21 with the intermediate transfer belt 31 interposed therebetween and to be rotatable around an axial line thereof by a driving unit (not shown). As the intermediate transfer roller 34, for example, a roller member including a conductive elastic member on a surface of a metal (for example, stainless steel) roller having a diameter of 8 to 10 mm may be used. The intermediate transfer roller 34 is connected to a power source (not shown) that applies a transfer bias voltage and has a function of transferring the toner image formed on the surface of the photoreceptor drum 21 to the intermediate transfer belt 31.

The transfer roller 36 is provided to come into pressure-contact with the driving roller 32 with the intermediate transfer belt 31 interposed therebetween, and to be rotatable around an axial line thereof by a driving unit (not shown). At a pressure-contact portion (transfer nip region) between the transfer roller 36 and the driving roller 32, the toner image borne on and conveyed by the intermediate transfer belt 31 is transferred onto a recording medium fed from the recording medium feeding section 50 described later.

The transfer belt cleaning unit 35 is provided to be opposite to the driven roller 33 in relation to the intermediate transfer belt 31, and to come into contact with a toner bearing surface of the intermediate transfer belt 31. The transfer belt cleaning unit 35 is provided to remove the toner on the surface of the intermediate transfer belt 31 and recovers the removed toner after the transfer of the toner image onto the recording medium. When the toner remains attached to the intermediate transfer belt 31 after the transferring of the toner image onto the recording medium, there is a problem that the remaining toner is attached to the transfer roller 36 when the intermediate transfer belt 31 runs. When the toner is attached to the transfer roller 36, the toner may contaminate the rear surface of the next recording medium onto which the transferring is to be performed.

According to the transfer section 30, when the intermediate transfer belt 31 runs while being brought into contact with the photoreceptor drum 21, a transfer bias with a polarity opposite to the charging polarity of the toner on the surface of the photoreceptor drum 21 is applied to the intermediate transfer roller 34, and the toner image formed on the surface of the photoreceptor drum 21 is transferred onto the intermediate transfer belt 31. The toner images of the respective colors formed by the photoreceptor drum 21*y*, the photoreceptor drum 21*m*, the photoreceptor drum 21*c*, and the photoreceptor drum 21*b* are sequentially overlaid and transferred onto the intermediate transfer belt 31 in this order and thereby a full color toner image is formed. The toner image transferred onto the intermediate transfer belt 31 is conveyed to the transfer nip region by running of the intermediate transfer belt 31 and is transferred onto a recording medium at the transfer nip region. The recording medium having the toner image transferred thereto is conveyed to the fixing section 40 described later.

The recording medium feeding section 50 includes a paper feed box 51, pick-up rollers 52*a* and 52*b*, conveying rollers 53*a* and 53*b*, registration rollers 54, and a paper feed tray 55. The paper feed box 51 is a container-like member that is provided at a vertically lower part of the image forming apparatus 100 and stores recording mediums at the inside of the image forming apparatus 100. The paper feed tray 55 is a tray-like member that is provided in a side wall surface of the image forming apparatus 100 and stores recording mediums at the outside of the image forming apparatus 100. Examples of the recording medium include regular paper, a sheet for color copying, a sheet for an overhead projector, and a postcard.

The pick-up roller 52*a* is a member that takes out the recording mediums stored in the paper feed box 51 one by one and feeds it to a paper conveyance path A1. The conveying rollers 53*a* are a pair of roller-like members, which are provided to come into pressure-contact with each other, and convey the recording medium in the paper conveyance path A1 toward the registration rollers 54. The pick-up roller 52*b* is a member that takes out the recording mediums stored in the paper feed tray 55 one by one and feeds it to a paper conveyance path A2. The conveying rollers 53*b* are a pair of roller-like members, which are provided to come into pressure-contact with each other, and convey the recording medium in the paper conveyance path A2 toward the registration rollers 54.

The registration rollers 54 are a pair of roller-like members, which are provided to come into pressure-contact with each other, and feeds the recording medium fed from the conveying rollers 53*a* or 53*b* to the transfer nip region in synchronization with conveyance of the toner image borne on the intermediate transfer belt 31 to the transfer nip region.

According to the recording medium feeding section 50, in synchronization with conveyance of the toner image borne on the intermediate transfer belt 31 to the transfer nip region, the recording medium is fed to the transfer nip region from the paper feed box 51 or the paper feed tray 55 and then the toner image is transferred onto the recording medium.

The fixing section 40 includes a heating roller 41 and a pressure roller 42. The heating roller 41 is controlled to maintain a predetermined fixing temperature. The pressure roller 42 is a roller that comes into pressure-contact with the heating roller 41. The heating roller 41 nips the recording medium together with the pressure roller 42 while heating the recording medium, and melts toner constituting the toner image and fixes it onto the recording medium. The recording medium having the toner image fixed thereon is conveyed to the discharge section 60 described later.

The discharge section 60 includes conveying rollers 61, discharge rollers 62, and a catch tray 63. The conveying rollers 61 are a pair of roller-like members, which are provided to come into pressure-contact with each other on a vertically upper side of the fixing section 40. The conveying rollers 61 convey the recording medium having an image fixed thereon toward the discharge rollers 62.

The discharge rollers 62 are a pair of roller-like members, which are provided to come into pressure-contact with each other. In the case of one-sided printing, the discharge rollers 62 discharge the recording medium on which the one-sided printing is completed to the catch tray 63. In the case of double-sided printing, the discharge rollers 62 convey the recording medium on which the one-sided printing is completed to the registration rollers 54 through a paper conveyance path A3 and discharges the recording medium on which the double-sided printing is completed to the catch tray 63. The catch tray 63 is provided in the vertically top surface of the image forming apparatus 100 and stores the recording mediums having the image fixed thereon.

The image forming apparatus 100 includes the control unit section (not shown). The control unit section is provided in the vertically upper part of the internal space of the image forming apparatus 100 and includes a memory portion, a computing portion, and a control portion. To the memory portion, various setting values mediated through an operation panel (not shown) disposed on the vertically upper surface of the image forming apparatus 100, the results detected by sensors (not shown) disposed in various portions inside the image forming apparatus 100, image information from an external device and the like are inputted. Moreover, programs for executing various processes are written in the memory portion. Examples of the various processes include a recording medium determination process, an attachment amount control process, and a fixing condition control process.

As for the memory portion, memories customarily used in this technical field can be used, and examples thereof include a read-only memory (ROM), a random-access memory (RAM), and a hard disc drive (HDD). As for the external device, electrical and electronic devices which can form or obtain the image information and which can be electrically connected to the image forming apparatus 100 can be used. Examples thereof include computers, digital cameras, televisions, video recorders, DVD (Digital Versatile Disc) recorders, HDDVD (High-Definition Digital Versatile Disc) recorders, Blu-ray disc recorders, facsimile machines, and mobile terminal devices.

The computing portion takes out various kinds of data (for example, image formation commands, detection results, and image information) written in the memory portion and the programs for various processes and then makes various determinations. The control portion sends a control signal to the respective devices provided in the image forming apparatus 100 in accordance with the determination result by the computing portion, thus performing control on operations.

The control portion and the computing portion include a processing circuit which is realized by a microcomputer, a microprocessor, and the like having a central processing unit (CPU). The control unit section includes a main power source as well as the processing circuit. The power source supplies electricity to not only the control unit section but also to respective devices provided in the image forming apparatus 100. Next, the toner cartridge 200 will be described.

Figure 2:
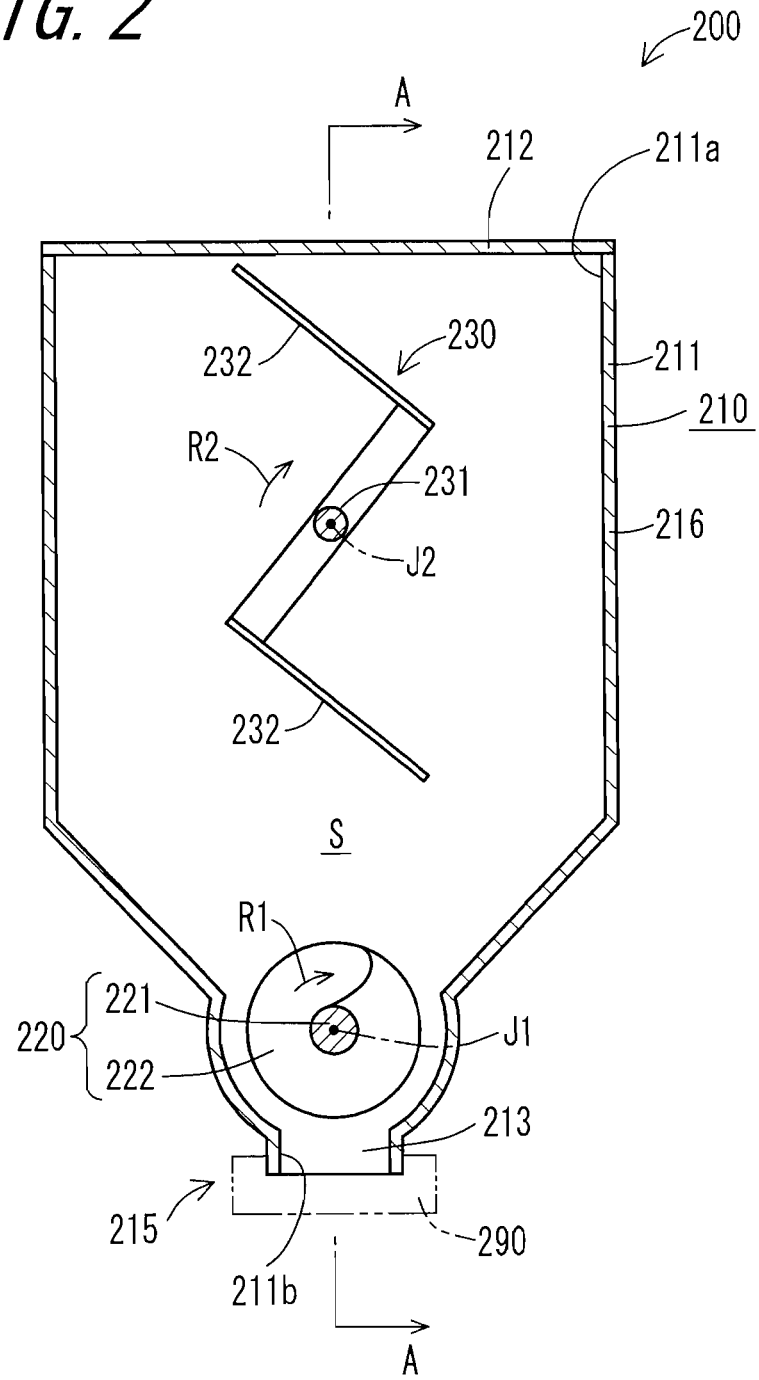
FIG. 2 is a simplified sectional view for explaining the structure of the toner cartridge in accordance with the first embodiment.
Figure 3:
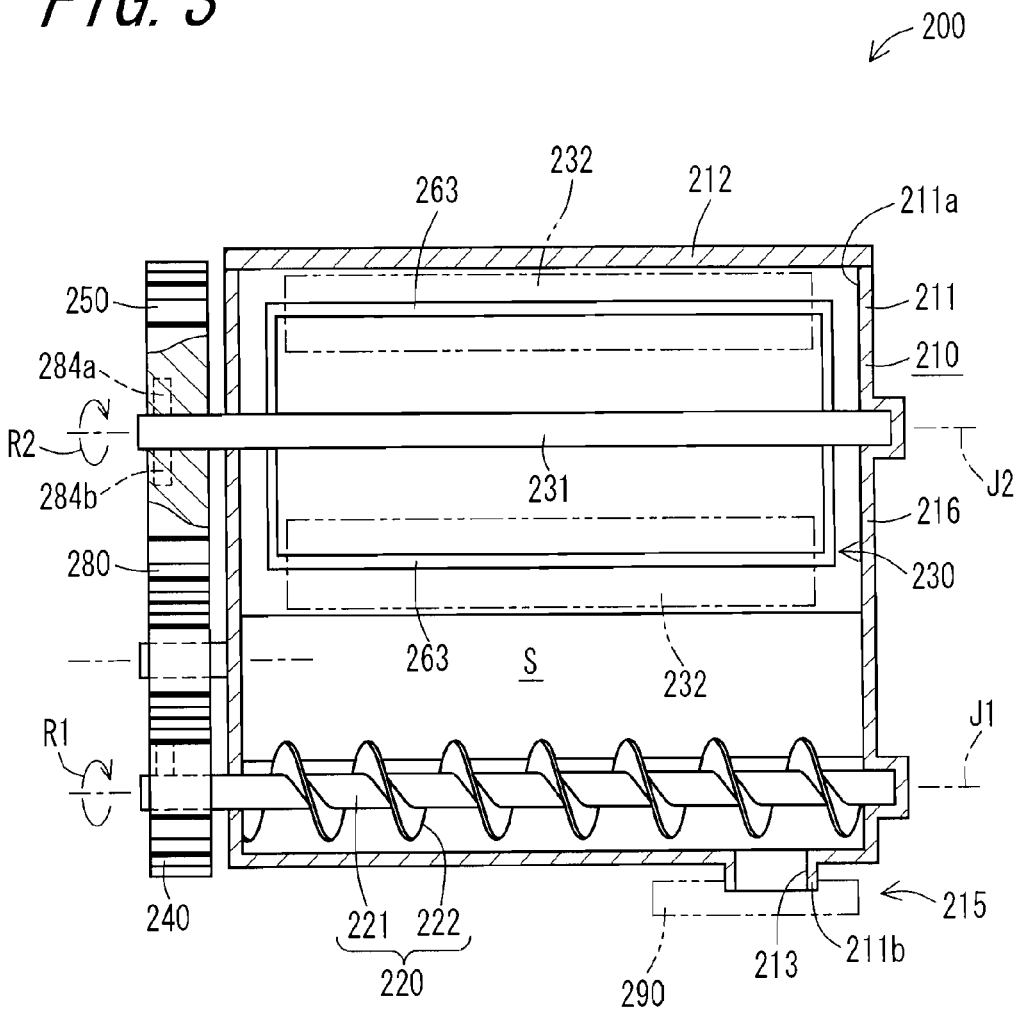
FIG. 3 is a sectional view taken along the line A-A of FIG. 2.

FIG. 2 is a simplified sectional view for explaining the structure of the toner cartridge 200 in accordance with the first embodiment (Example 1), and FIG. 3 is a sectional view taken along the line A-A of FIG. 2. Herein, "an up-down direction of the toner cartridge 200" refers to a direction coinciding with a up-down direction of the image forming apparatus 100 under a condition where the toner cartridge 200 is mounted in the image forming apparatus 100, or equivalently a direction coinciding with the vertical direction.

The toner cartridge 200 generally comprises a toner storage container 210, a toner discharge member 220, a toner stirring member 230, a first gear 240, a second gear 250, and a toner discharge port opening/closing mechanism 290.

The toner storage container 210, which is a container-like member having an internal space serving as a toner storage space S for storing a toner which is to be supplied to the developing device 24, includes a container 211 and an upper lid 212. The container 211 is a bottomed container-like member having an opening 211*a* formed at its upper end so as to be opened upward. The upper lid 212 is a plate-like member for blocking an opening defined by the opening 211*a*.

The container 211 has, at its lower end, an opening 211*b* which is substantially equal in shape and size to the upper opening of the toner supply pipe 300 provided in the image forming apparatus 100. The opening part 211*b* constitutes a toner discharge port 213 for providing communication between the toner storage space S and an external space below the toner storage container 210 in the vertical direction.

At the lower end of the container 211, the toner discharge port 213 is formed at a position where the toner discharge port 213 can communicate with an opening defined by the upper opening of the toner supply pipe 300 under a condition where the toner cartridge 200 is mounted in the image forming apparatus 100. In this embodiment, as will hereafter be described, the toner discharge port 213 is formed on the other side of a toner discharge section 215 in a depth direction (a right-left, or horizontal direction as viewed in FIG. 3) of the toner discharge section 215. Depending on a situation as to consumption of toner stored in the developer tank in the developing device 24, a toner is supplied from the toner cartridge 200 into the developer tank through the toner discharge port 213.

The toner discharge member 220 is disposed in a lower region of the toner storage space S. The toner discharge member 220 is an auger screw member including a conveyance shaft 221 acting as a second rotating shaft and a conveyance blade 222, and is rotatably supported by one wall and the other wall of the toner discharge section 215 in the depth direction so that an axial line J1 of the conveyance shaft 221 extends in parallel with the depth direction.

The conveyance shaft 221 is a cylindrical member having an outer diameter in a range of 3 mm to 10 mm, for example. The conveyance shaft 221 has its one end portion in the axial direction provided so as to pass through one wall of the toner discharge section 215 in the depth direction and protrude outward from the wall, and, the first gear 240 is coupled to the one end portion. The conveyance shaft 221 is made of a material such for example as polyethylene, polypropylene, high-impact polystyrene, or ABS resin (acrylonitrile-butadiene-styrene copolymer synthetic resin).

The conveyance blade 222 is a spiral-shaped member disposed so as to surround the conveyance shaft 221. The conveyance blade 222 has an outer diameter in a range of 12 mm to 25 mm, for example. The conveyance blade 222 is made of a material such for example as polyethylene, polypropylene, high-impact polystyrene, or ABS resin, and is preferably formed integrally with the conveyance shaft 221. The spiral pitch, outer diameter, and so forth of the conveyance blade 222 are determined appropriately so that the speed of toner conveyance in the toner storage space S can conform to a predetermined speed level, in consideration of, for example, the speed of rotation of the toner discharge member 220 about the axial line J1.

The first gear 240 is a driving-force transmitting member fixed to the one end portion of the conveyance shaft 221 of the toner discharge member 220. A driving force is transmitted from the second gear 250 described later via a third gear 280 described later to the first gear 240.

The toner discharge member 220 conveys a toner stored in the toner storage space S within the toner discharge section 215 from one side to the other side in the depth direction, in other words, from a communicating-port-214-forming side to a toner-discharge-port-213-forming side in the depth direction by the rotation in a rotational direction R1 about the axial line J1 under the driving force transmitted thereto via the first gear 240. The toner which is being conveyed toward the other side in the depth direction under the turning motion of the toner discharge member 220 is, upon reaching a region above the toner discharge port 213, dropped down through the toner discharge port 213 so as to be discharged from the toner cartridge 200, and is then supplied into the developer tank of the developing device 24 through the toner supply pipe 300.

Meanwhile, the toner stirring member 230 is disposed in an upper region of the toner storage space S. The toner stirring member 230 includes a rotating shaft 231 acting as a first rotating shaft installed between one wall and the other wall of a toner storage section 216 in its depth direction, and a sheet-shaped stirring blade 232 retained by the rotating shaft 231. The rotating shaft 231 is rotatably supported by one wall and the other wall of the toner storage section 216 in the depth direction so that its axial line J2 extends in parallel with the depth direction.

The rotating shaft 231 is generally installed between one wall and the other wall of the toner storage section 216 in the depth direction so as to be rotatably supported by the walls for free turning motion about the axial line J2, and is made of a material such for example as polyethylene, polypropylene, high-impact polystyrene, or ABS resin.

One end portion of the rotating shaft 231 passes through one wall of the toner storage section 216 in the depth direction. A part of the one end portion which protrudes outward from the one wall in the depth direction is coupled to the second gear 250 which is a differential member.

A pair of concave stirring-blade retaining pieces 263 is fixed to the rotating shaft 231 intermediately thereof. The stirring blades 232 are attached to free end portions of the respective stirring-blade retaining pieces 263. The stirring blade 232 is a flexible sheet-shaped member, and is fixed to the stirring-blade retaining piece 263*b*. Although there is no particular limitation to the material constituting the stirring blade 232 so long as it exhibits flexibility, for example, polyethylene terephthalate (PET) resin is desirable for use. Moreover, the stirring blade 232 has a thickness in a range of 0.1 mm to 0.5 mm, for example. The details of the stirring blade 232 will be will be given later on.

The second gear 250 serves also as a driving-force transmitting member fixed to one end portion of the rotating shaft 231 of the toner stirring member 230, and is disposed so as to engage with a gear connected to a driving source (motor) provided in the image forming apparatus 100 under a condition where the toner cartridge 200 is mounted in the image forming apparatus 100. The second gear 250 rotates the toner stirring member 230 in a rotational direction R2 about the axial line J2 upon receipt of input of a driving force outputted from the driving force. The driving source is connected to the control portion of the image forming apparatus 100, so that the turning motion of the toner stirring member 230 can be controlled by the control portion. Moreover, the rotational direction R2 coincides with a clockwise direction when viewed from one side in the depth direction.

The third gear 280, which serves as a rotation transmitting portion, is rotatably supported on the toner storage section 216 so as to engage with the first gear 240 and the second gear 250. The third gear 280 transmits the rotation of the second gear 250 to the first gear 240.

Next, the stirring blade 232 will be described in detail. The stirring blade 232 is substantially rectangular-shaped when viewed in the thickness direction thereof. A base end of the stirring blade 232, which is an edge part thereof, is fixed to the free end portion of the stirring-blade retaining piece 263 along the depth direction, and, with respect to a direction perpendicular to both of the thickness direction and the extension direction of the base end, a free end portion of the stirring blade 232, which is an edge part thereof extending in the direction opposite to the base end, is located on an upstream side of the base end in the rotational direction R2.

Accordingly, when the remaining amount of a toner stored in the toner storage section 216 becomes smaller, each of the stirring blades 232 is convexly bent and deformed on a downstream side in the rotational direction R2, with its free end portion sliding on the inner surface of each wall of the toner storage section 216, thereby scraping off a toner attached to the inner surface of the toner storage section 216.

Figure 4:
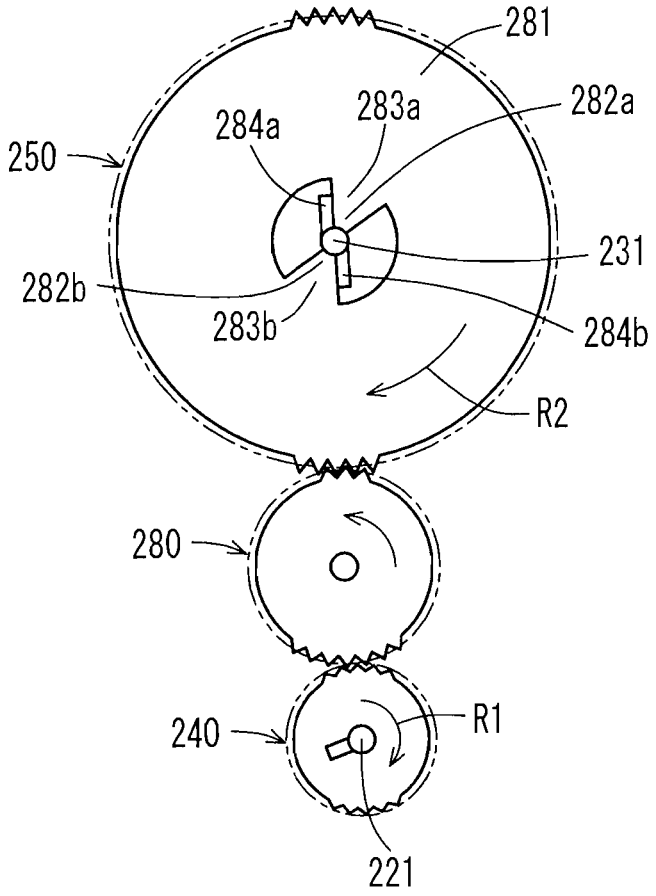
FIG. 4 is a side view showing first to third gears.
Figure 5A:
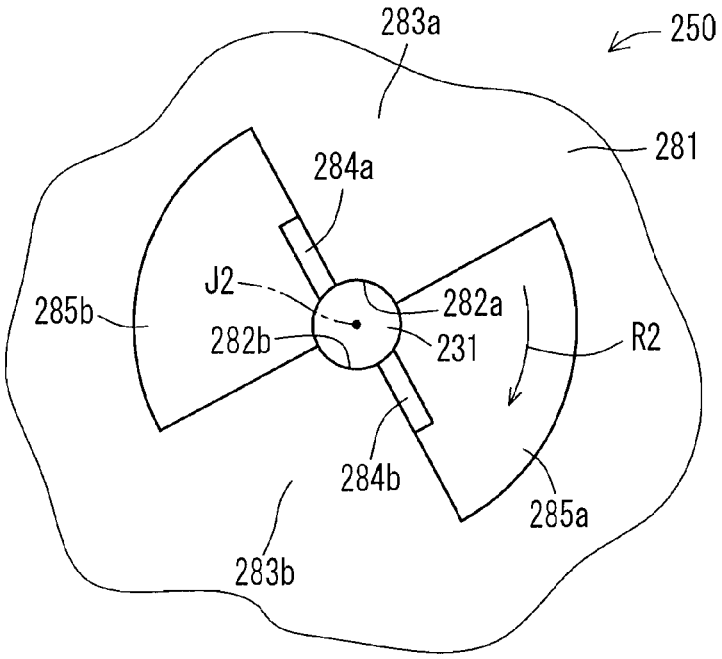
FIG. 5A and FIG. 5B are partly enlarged views showing bearing projections and abutment members of a second gear.
Figure 5B:
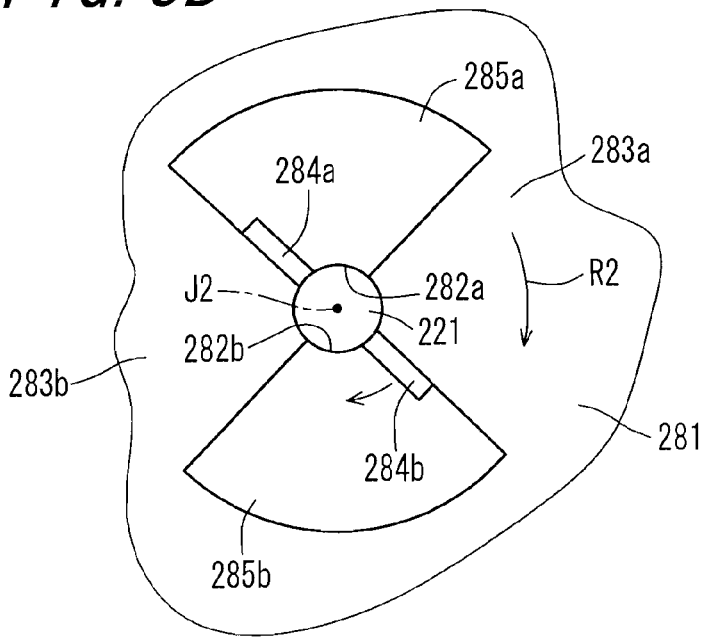

FIG. 4 is a side view showing the first to third gears 240, 250, and 280, and FIG. 5A and FIG. 5B are partly enlarged views showing bearing projections 283*a* and 283*b* and abutment members 284*a* and 284*b* of the second gear 250. The second gear 250 comprises a base part 281 composed of an annular plate body, and bearing projections 283*a* and 283*b* which protrude radially inwardly from an inner peripheral surface of the base part 281, with its front end 282*a*, 282*b* rotatably supported in contact with an outer peripheral surface of the rotating shaft 231 acting as the first rotating shaft.

A part of one end portion of the rotating shaft 231 in the axial direction which protrudes from one of the walls of the toner storage container 210 in the depth direction is provided with a pair of plate-like abutment members 284*a* and 284*b* protruding radially outwardly from the outer peripheral surface of the rotating shaft 231 that are axisymmetrically disposed against which the bearing projections 283*a* and 283*b* abut under the rotation of the second gear 250.

Through holes 285*a* and 285*b* having a substantially circular sector shape are formed between the bearing projections 283*a* and 283*b* of the second gear 250 in a circumferential direction thereof, and, the abutment members 284*a* and 284*b* are movably inserted in the through hole 285*a*, 285*b* in the rotational direction R2, as well as in a direction reverse to the rotational direction R2. In the present embodiment, central angles of the respective substantially circular sector-shaped through holes 283*a* and 283*b* are preferably 90°.

In the toner cartridge 200 thusly constructed, on startup, until the second gear 250 rotates by a quarter turn, the rotating shaft 231 does not rotate together with the second gear 250, so that only the conveyance shaft 221 rotates by means of the third gear 280 and the first gear 240, whereby the toner discharge member 220 rotates prior to the rotation of the toner stirring member 230. When the second gear 250 rotates over a quarter turn, the respective bearing protrusions 283*a* and 283*b* abut against the respective abutment members 284*a* and 284*b*, so that the second gear 250 and the rotating shaft 231 rotate together, and the conveyance shaft 221 rotates by means of the third gear 280 and the first gear 240, whereby the toner discharge member 220 rotates together with the toner stirring member 230. That is, the toner stirring member 230 is rotated as the bearing projections 283*a* and 283*b* of the second gear 250 abut against the abutment members 284*a* and 284*b* on startup, and also the rotation of the second gear 250 is transmitted to the conveyance shaft 221 via the third gear 280 and the first gear 240. Thus, even if a toner stored in the toner storage container 210 is in a solidified state, the toner can be loosened by rotating only the toner discharge member 220 first, and then the toner stirring member 230 can be rotated without producing an excessive rotation torque on startup.

Moreover, with the provision of the toner cartridge 200 in an image forming apparatus, it is possible to render the image forming apparatus capable of forming high-quality images without causing image defects such as an image void.

Figure 6:
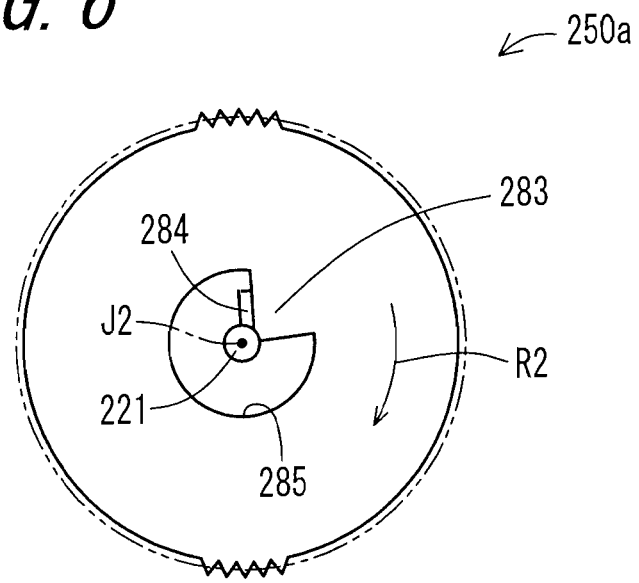
FIG. 6 is a diagram showing a second gear in accordance with a second embodiment.

FIG. 6 is a diagram showing a second gear 250*a* in accordance with a second embodiment (Example 2). While the second gear 250 of the preceding embodiment is illustrated as having a structure composed of the paired bearing projections 283*a* and 283*b* and the paired abutment members 284*a* and 284*b*, by way of the second embodiment, it is possible to construct a toner cartridge and an image forming apparatus with use of the second gear 250*a* composed of a single bearing projection 283 and a single abutment member 284. In the present embodiment, a central angle of a substantially circular sector-shaped through hole 285 defined by the single bearing protrusion 283 is preferably 270°. In this case, on startup, until the second gear 250*a* rotates by a three-quarter turn, the rotating shaft 231 does not rotate together with the second gear 250*a*, so that only the conveyance shaft 221 rotates by means of the third gear 280 and the first gear 240, whereby the toner discharge member 220 rotates prior to the rotation of the toner stirring member 230. When the second gear 250*a* rotates over a three-quarter turn, the bearing protrusion 283 abuts against the abutment member 284, so that the second gear 250*a* and the rotating shaft 231 rotate together, and the conveyance shaft 221 rotates by means of the third gear 280 and the first gear 240, whereby the toner discharge member 220 rotates together with the toner stirring member 230. By adopting such a construction using the second gear 250*a* realized by a single bearing projection 283 and a single abutment member 284, it is possible to afford the same advantageous effects as achieved by the toner cartridge 200 and the image forming apparatus 100 of the preceding embodiment.

In a third embodiment (Example 3), the control unit of the image forming apparatus described above is designed to exercise control so as to rotate the second gear 250, 250*a* in normal and reverse directions within a certain movable range without causing a contact between the bearing projection and the abutment member. In this case, after a toner which remains in a solidified state around the toner discharge port 213 is loosened thoroughly by rotating the toner discharge member 220 alternately in the normal and reverse directions, it is possible to discharge the loosened toner.

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and the range of equivalency of the claims are therefore intended to be embraced therein.

What is claimed is:

1. A toner cartridge mountable in an electrophotographic image forming apparatus provided with a developing device, comprising:

a toner storage container including a toner storage section for storing a toner in an interior thereof, a toner discharge section located on a vertically lower side of the toner storage section in a mounted state in the image forming apparatus, the toner discharge section having a toner discharge port for toner discharge, and a communicating port forming section which forms a communicating port for guiding a toner stored in the toner storage section toward the toner discharge section;

a toner stifling member which stirs a toner stored in the toner storage section, including a first rotating shaft rotatably supported on the toner storage section, and a flexible sheet-like stifling blade of which one end portion in a predetermined first direction perpendicular to a thickness direction is fixed to the first rotating shaft along an axial line thereof, the flexible sheet-like stifling blade having a length in the predetermined first direction so that the other end portion in the predetermined first direction comes into contact with an inner surface of the toner storage section;

a toner discharge member which conveys a toner which has been guided from the toner storage section to the toner discharge section through the communicating port toward the toner discharge port, including a second rotating shaft rotatably supported on the toner discharge section, and a spiral-shaped conveyance blade attached to the second rotating shaft along an axial line thereof;

a differential member including a base part composed of an annular plate body, and a plurality of bearing projections which protrude radially inwardly from an inner peripheral surface of the base part, the differential member being provided with through holes formed between the bearing projections, the bearing projections being rotatably supported in contact with an outer peripheral surface of the first rotating shaft;

an abutment member protruding from the outer peripheral surface of the first rotating shaft, against which the plurality of bearing projections abut under a rotation of the differential member, the abutment member being inserted in the through holes;

a rotation transmitting portion which transmits a rotation of the differential member to the second rotating shaft, wherein the rotation transmitting portion is configured such that the second rotating shaft always begins to rotate at essentially the same time that the differential member begins to rotate; and a rotationally driving section which imparts a rotating force to the differential member.

2. The toner cartridge of claim 1, wherein the plurality of bearing projections, as well as a plurality of the abutment members, are axisymmetrically disposed with respect to the axial line of the first rotating shaft.

3. The toner cartridge of claim 2, wherein in the base part, a plurality of substantially circular sector-shaped through holes are formed between the plurality of bearing projections, and central angles of the respective plurality of substantially circular sector-shaped through holes are 90°.

4. The toner cartridge of claim 1, wherein the rotationally driving section rotates the differential member in normal and reverse directions within a certain movable range without causing contacts of the plurality of bearing projections with the abutment member.

5. An electrophotographic image forming apparatus provided with a developing device, comprising the toner cartridge of claim 1 which supplies a toner to the developing device.

* * * * *